US007784626B2

(12) United States Patent
Jacques et al.

(10) Patent No.: US 7,784,626 B2
(45) Date of Patent: Aug. 31, 2010

(54) WALL HANGING SYSTEM

(75) Inventors: Alain Jacques, 80, av. Des Terrasses, Laval, Québec (CA) H7H 1S9; Annie Ducharme, Montréal (CA); Patrice Fallu, Montréal (CA)

(73) Assignee: Alain Jacques, Laval, Québec (CA)

( * ) Notice: Subject to any disclaimer, the term of this patent is extended or adjusted under 35 U.S.C. 154(b) by 532 days.

(21) Appl. No.: 11/156,533

(22) Filed: Jun. 21, 2005

(65) Prior Publication Data

US 2006/0283822 A1 Dec. 21, 2006

(51) Int. Cl.

| | |
|---|---|
| ***A47H 1/00*** | (2006.01) |
| ***A47B 5/00*** | (2006.01) |
| ***A47B 43/00*** | (2006.01) |
| ***A47B 47/00*** | (2006.01) |
| ***A47B 57/00*** | (2006.01) |

(52) U.S. Cl. ..... 211/103; 211/190

(58) Field of Classification Search ..... 211/103, 211/59.1, 187, 190, 94.04, 113, 189; 248/220.31, 248/225.21, 225.11, 220.21, 220.41; 280/47.34, 280/408; 312/198; D6/553

See application file for complete search history.

(56) References Cited

U.S. PATENT DOCUMENTS

| | | | | |
|---|---|---|---|---|
| 3,241,850 | A | 3/1966 | Propst | |
| 3,665,997 | A * | 5/1972 | Smith et al. | 52/173.2 |
| 3,730,477 | A * | 5/1973 | Wavrunek | 248/243 |
| 3,828,495 | A * | 8/1974 | Law | 52/36.6 |
| 3,950,049 | A * | 4/1976 | Drass | 312/245 |
| 4,329,003 | A | 5/1982 | Manchester | |
| 4,441,300 | A * | 4/1984 | Varon et al. | 52/481.2 |
| 4,638,606 | A * | 1/1987 | Wendt | 52/36.6 |
| 4,651,797 | A * | 3/1987 | Lange | 160/290.1 |
| 5,110,080 | A * | 5/1992 | Rieman | 248/225.11 |
| 5,209,035 | A * | 5/1993 | Hodges et al. | 52/220.7 |
| D342,015 | S * | 12/1993 | Andrejew | D8/373 |
| 5,277,393 | A * | 1/1994 | Nicholson et al. | 248/243 |
| 5,392,934 | A * | 2/1995 | Fox | 211/94.01 |
| 5,505,244 | A * | 4/1996 | Thumann | 160/23.1 |
| 5,779,065 | A * | 7/1998 | Thalenfeld et al. | 211/87.01 |
| 6,053,235 | A * | 4/2000 | Ruffner, Sr. | 160/89 |
| 6,676,205 | B2 * | 1/2004 | Lin | 296/214 |
| 6,688,568 | B1 | 2/2004 | Moufflet | |
| D490,697 | S * | 6/2004 | Runnalls | D8/380 |
| 2002/0069601 | A1 * | 6/2002 | Hodges et al. | 52/481.2 |

* cited by examiner

*Primary Examiner*—Katherine W Mitchell
*Assistant Examiner*—Jeremy C Ramsey
(74) *Attorney, Agent, or Firm*—Ogilvy Renault LLP

(57) ABSTRACT

A wall hanging system is comprised of a rigid straight load support strip securable in a horizontal position on a wall surface. The load support strip has a holding flange formed integral therewith and bent obliquely upward and outward. Two or more straight suspension rails, each having an attaching slot at upper end portion thereof extending transversely from a rear face thereof. The slot is configured to receive the holding flange there across whereby to hang the suspension rail from the load support strip at a desired location thereal-ong. The suspension rail has a straight front central slot and a recessed connector bar spaced inwardly of an open front end of the slot for removable sercurement of article support connectors thereto. The connector bar is concealed inside the central slot.

9 Claims, 9 Drawing Sheets

WALL HANGING SYSTEM

TECHNICAL FIELD

The present invention relates to a wall hanging system comprised of a horizontal load support strip securable to a wall surface and two or more straight suspension rails which are each provided with a central slot for access to a recessed connector inwardly thereof. The system is concealed in the assembly with its furnishing articles, it is flexible and easy to use.

BACKGROUND ART

Various wall hanging systems are known for supporting cabinetary or shelving on a wall surface. Some of these known systems are for use in supporting cabinets, shelving, etc. in closets or kitchen wall surfaces. Examples of these are referenced by U.S. Pat. Nos. 3,241,850; 5,392,934; 3,950,049 and 4,329,003. In these examples it can be seen that the horizontal suspension bars may be visible inbetween hanging cabinets or entirely concealed behind cabinetary.

U.S. Pat. No. 6,688,568 also discloses a wall suspension system whereby vertical rods are also secured to and displacable along a horizontal suspension bar secured to a wall for suspending articles. U.S. Design Pat. Nos. D342015 and D490697 also illustrate suspension rail assemblies for mounting articles on walls such as shelving. However, with these latter references, the horizontal and vertical rods remain visible, at least in greater part.

There is a need to provide a wall hanging system which is comprised of a horizontal load support strip and depending vertical suspension rails and to which a multitude of articles of furnishing can be attached in a modular fashion while providing an aesthetic pleasing appearance with the load support strip being invisible and further wherein the suspension rails are integrated in the design with the connectors being non-visible and further wherein the articles of furnishing secured to the system are easily disconnected and replaced or shifted as desired by the user person. The system needs to be totally flexible and permitting a variety of designs.

SUMMARY OF INVENTION

It is therefore a feature of present invention to provide a wall hanging system which fulfills the required needs as above-described.

According to a broad aspect of the present invention there is therefore provided a wall hanging system comprising a rigid straight load support strip having means to secure the load strip in a horizontal position on a wall surface. The load support strip further as a holding flange formed integral therewith and bent obliquely upward and outward of the support strip. Two or more straight suspension rails are provided and each have an attaching slot extending from a rear portion thereof and configured to receive the holding flange there across for suspending the suspension rail therefrom at a desired location therealong. The suspension rail has a straight central vertical slot and a recess connector spaced inwardly of an open front end of the straight central vertical slot for removable securement of article support connectors thereto.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
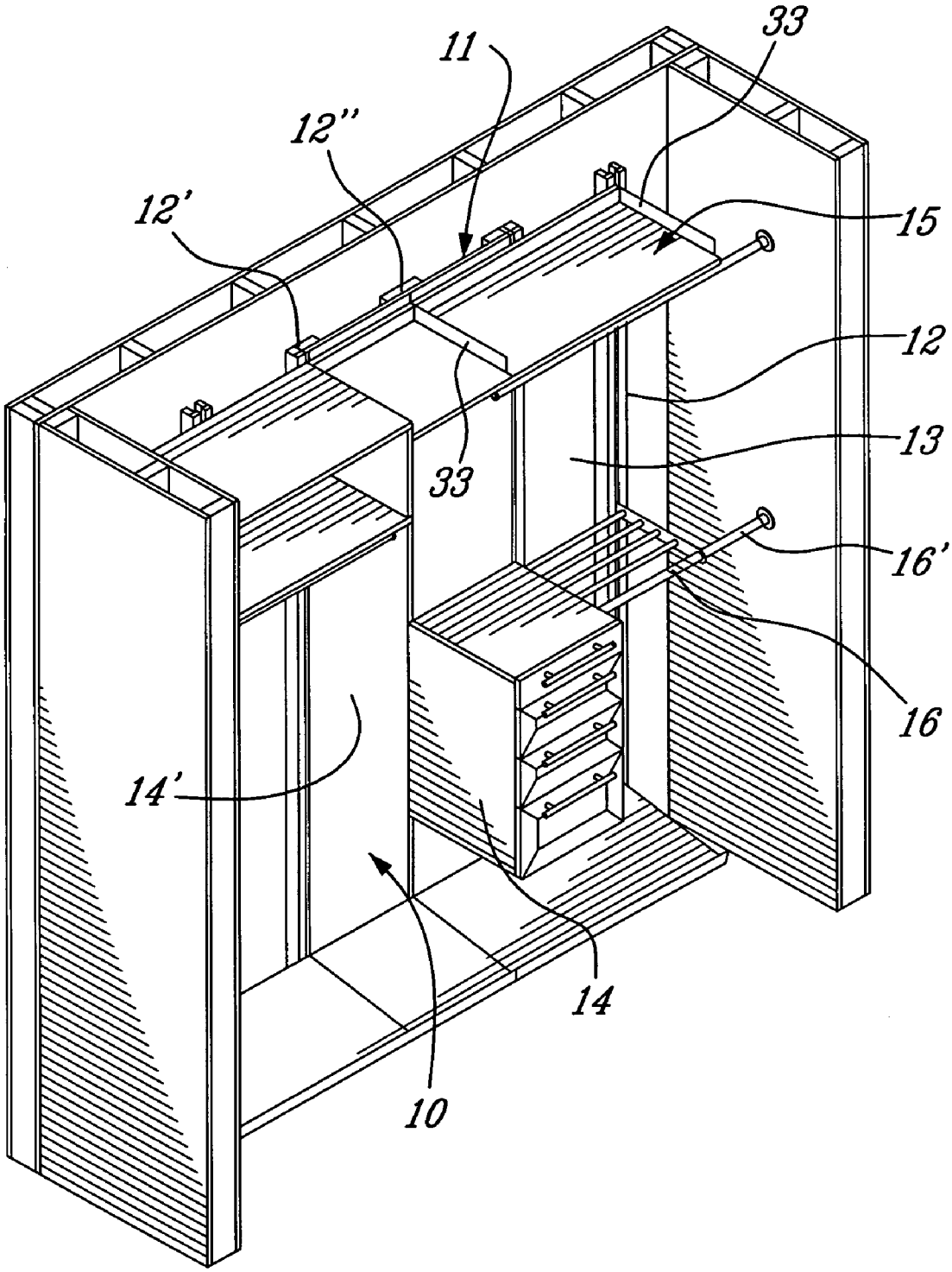
FIG. 1 is a perspective view of the wall hanging system of the present invention and to which is secured an assembly of modular articles of furnishing.
Figure 2:
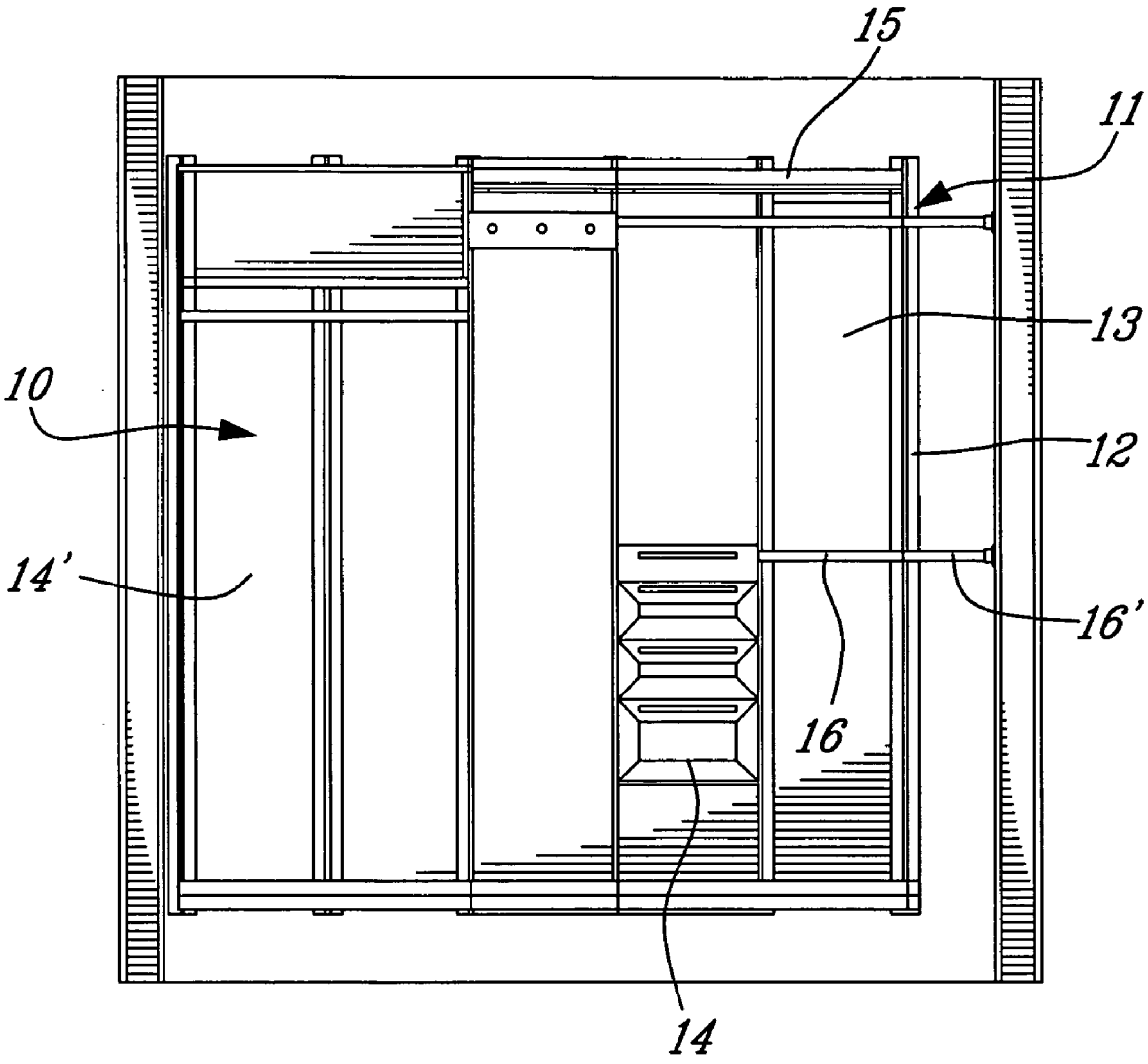
FIG. 2 is a front view of the wall hanging system assembly of FIG. 1.

Referring now to the drawings and more particularly to FIGS. 1 and 2 there is shown a plurality of articles of furnishing 10 secured to the wall hanging system 11 of the present invention and wherein only the suspension rails 12 are visible. As herein shown the articles of furnishing 10 may comprise wall panels 13, cabinetry 14 with drawers or other form of cabinetry such as illustrated at 14', shelving 15, hanging rods 16 including telescopic rods 16' and a multitude of other articles of furnishing depending on the need of the user. When viewed from the front, as shown FIG. 2 it can be seen that the suspension rails 12 are integrally incorporated with the articles of furnishing and appear to be an integrated component. The wall connectors are not visible.

Figure 3:
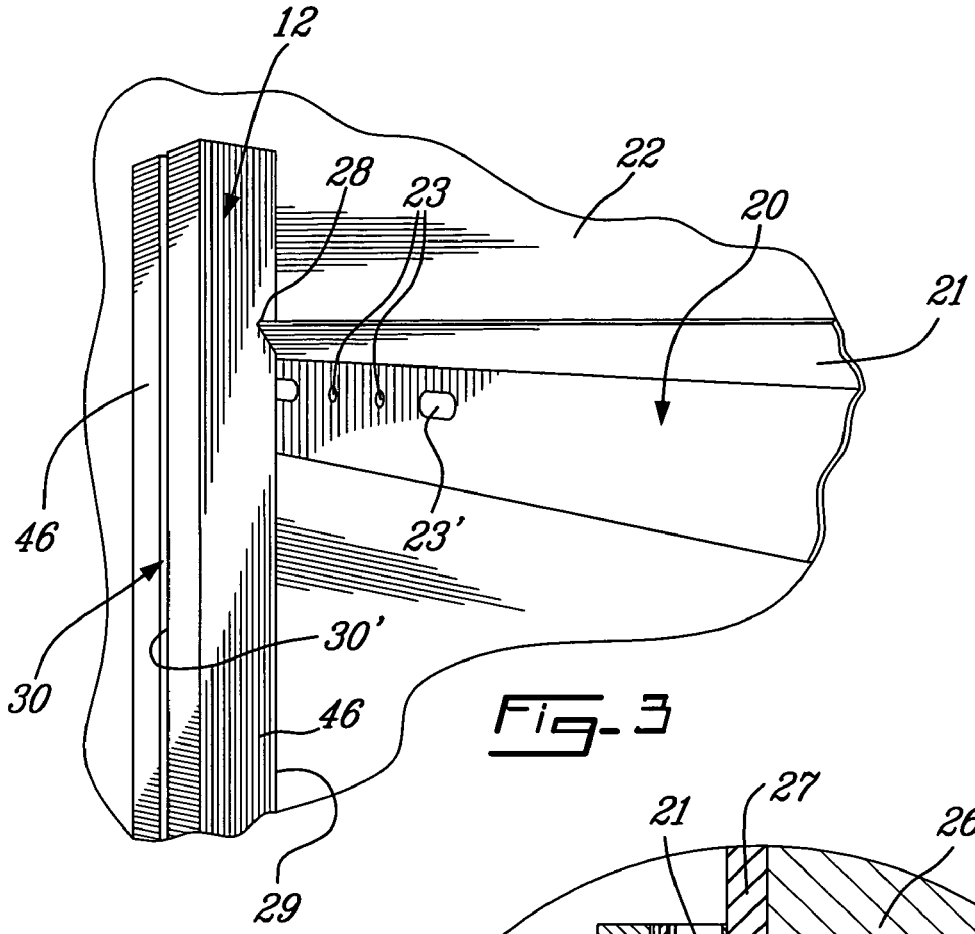
FIG. 3 is a fragmented perspective view showing the main elements of the wall hanging system of the present invention and comprised of a load support strip secured to a wall with a suspension rail displacaebly attached thereto.
Figure 4:
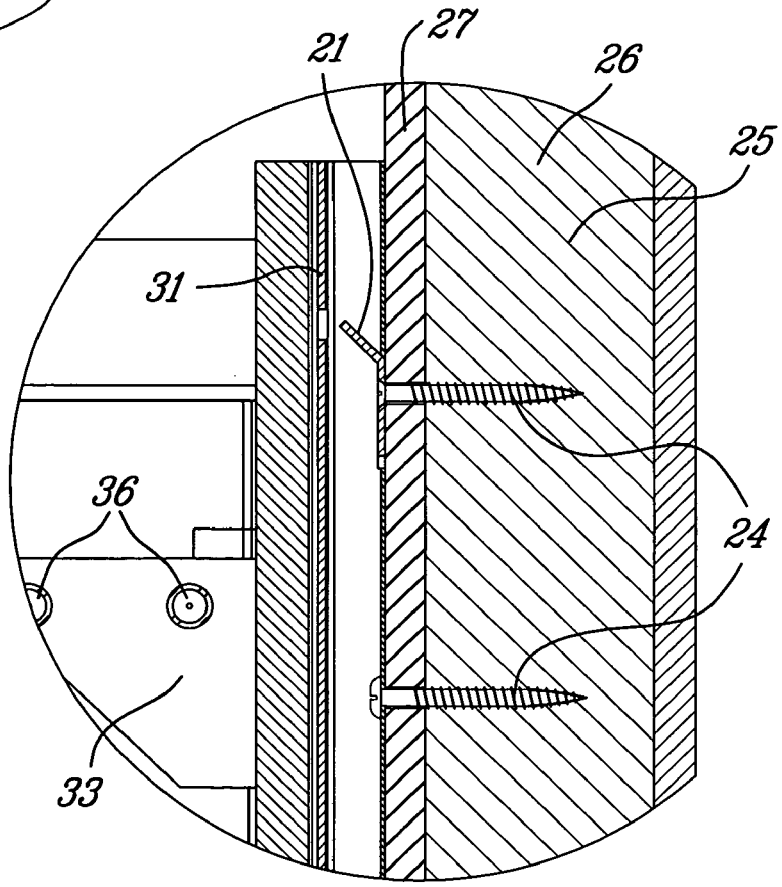
FIG. 4 is a fragmented side section view of the wall hanging system of FIG. 3.

Referring now to FIGS. 3 to 7 there will be described the details of the construction of the wall hanging system 11 and it is comprised of a straight load support strip 20 formed from an elongated flat metal bar which is bent to define a holding flange 21 formed integral therewith. The flange 21 is bent obliquely upward and outward when the support strip 20 is secured to a wall surface 22. The load support strip is provided with holes 23 and slots 23' to receive fasteners 24, see FIG. 4, whereby to secure the strip horizontally on the wall 22 and more precisely to vertical studs 25 inside the wall structure 26 and behind the usual gyps boards 27 which are secured to the studs, as shown in FIG. 4. Accordingly, the load on the strip is transferred to the studs in the wall.

The wall hanging system 11 of the present invention further comprises, as previously described, two or more straight vertical suspension rails 12 which are each provided with a slot 28 also extending obliquely upward from a rear portion 29 of the rail and across the rail This slot 28 is configured to receive the holding flange 21 thereacross for suspending holding flange of the the suspension rail 12 therefrom at a desired location along the support strip 20. Accordingly, the suspension rails 12 are displaceable along the holding flange 21 whereby to position the rails at a desired location depending on the articles to be attached thereto. As also shown in FIG. 3, the suspension rail 12 is provided with a straight central vertical slot 30 and a recess connector bar 31 (see FIGS. 4 and 5). The connector bar is secured and spaced inwardly of the open front end 30' of the slot 30 whereby to conceal the connector bar 31.

Figure 7:
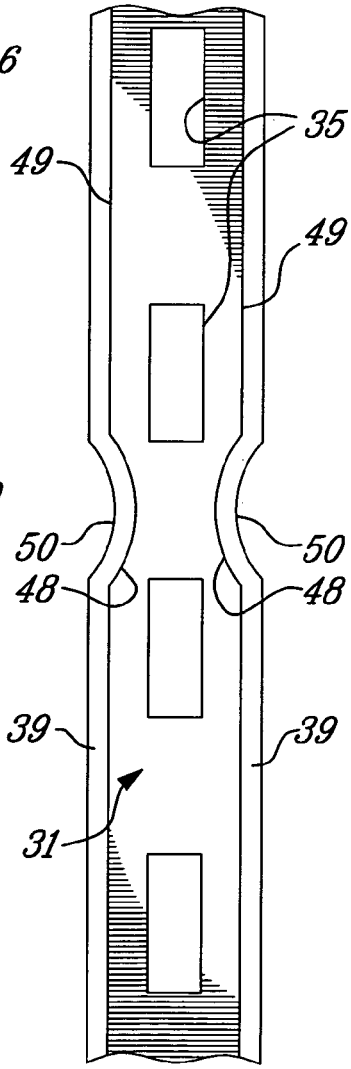
FIG. 7 is a fragmented front view illustrating the manner in which the connector bar is secured in the extruded rail.
Figure 8:
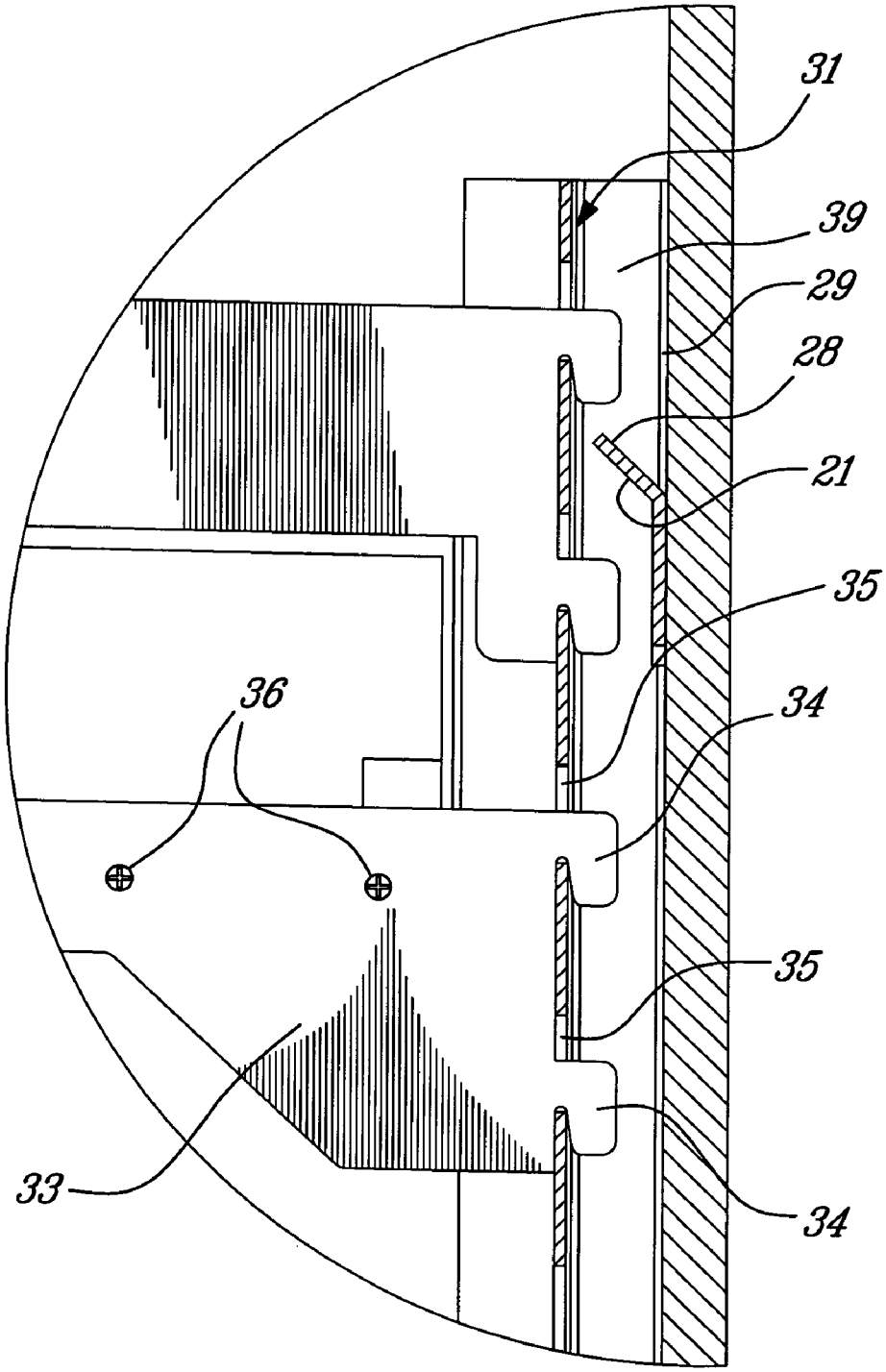
FIG. 8 is a fragmented side view showing the connection of article support connectors to the connector bar concealed within the rail.

As shown in FIG. 8 some of the articles of furnishing, such as the cabinetry 14, are attached between a pair of suspension rails such as rails 12' and 12" by article support connectors, herein metal support connectors 33, of a type well known in the art, and which are comprised of flat metal brackets each having at least two spaced apart connecting fingers 34 projecting from a rear edge of the connector for support engagement with straight connector slots 35 formed in the connector bar 31. The connector bar 31 is better illustrated in FIG. 7 and it is comprised of a flat metal bar having a plurality of spaced apart vertically disposed straight connecting slots 35. The connecting fingers 34 of the support connectors 33 engage with at least two of these slots 35 in a manner well known in the art, as illustrated in FIG. 8, whereby to suspend the article of furnishing such as the cabinet 14 therefrom. Holes 36 are provided in these metal support connectors 33 for securement to an article of furnishing or shelving or a multitude of other articles that need to be suspended from the rails. The metal support connectors 33 may have many shapes, not illustrated but obvious.

Figure 5:
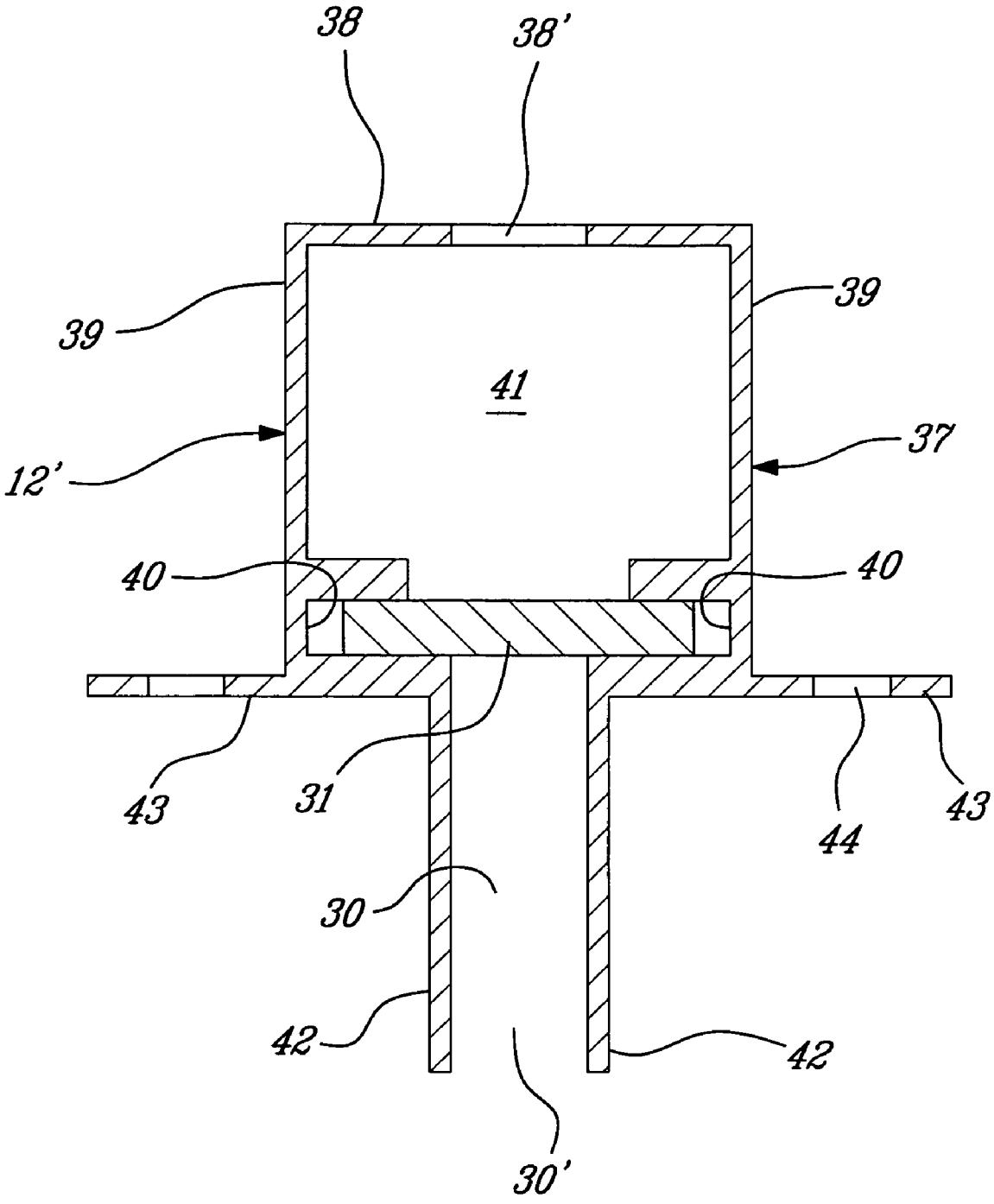
FIG. 5 is a section view showing the construction of the extruded metal rail with the connector bar disposed and secured therein.

With reference now more specifically FIG. 5 there is shown the construction of the suspension rail 12 and it is comprised essentially of an extruded metal rail member 12', preferably extruded from aluminum, and defining an elongated U-shaped rear channel 37 having a straight flat rear wall 38 and opposed side walls 39 herein shown as straight flat side walls whereby the rear channel 37 is a rectangular channel. The slot 28 extends through the opposed side walls 39 and rear wall 38 as shown in FIG. 8 and as well through rails 12, as shown in FIG. 3. A connector bar receiving channel 40 extends along an open front end of the rear channel 37 from opposed side walls 39 for receiving therein the elongated connector bar 31 which is disposed in sliding fit between the connector receiving channels 40 whereby to bridge the open end of the rear channel 37. This connector bar 31 also extends parallel and spaced forwardly of the flat rear wall 38 whereby an inner space 41 is defined therebetween to receive the connecting fingers 34 of the metal support connectors 33 or other type connectors.

The rear wall 38 is also provided with one or more holes 38' therein for receiving a fastener to immobilize the suspension rail 12 at a precise vertical position over the wall surface 22 as shown in FIG. 3. However, it is pointed out that once the furnishing articles are secured to these rails and because of the square nature of these furnishings, these rails will automatically lie along a straight vertical axis as they are depending from the load support strip 20 which has been precisely leveled and secured on a horizontal axis and at a desired location on the wall surface.

The extruded metal railber member 12' also defines a pair of spaced vertical flanges 42 defining therebetween the straight central slot 30 and these vertical flanges 42 project forwardly of the front end of the rear channel 37 whereby the connector bar 31 is recessed inwardly and concealed within the rail assembly 12.

Figure 6A:
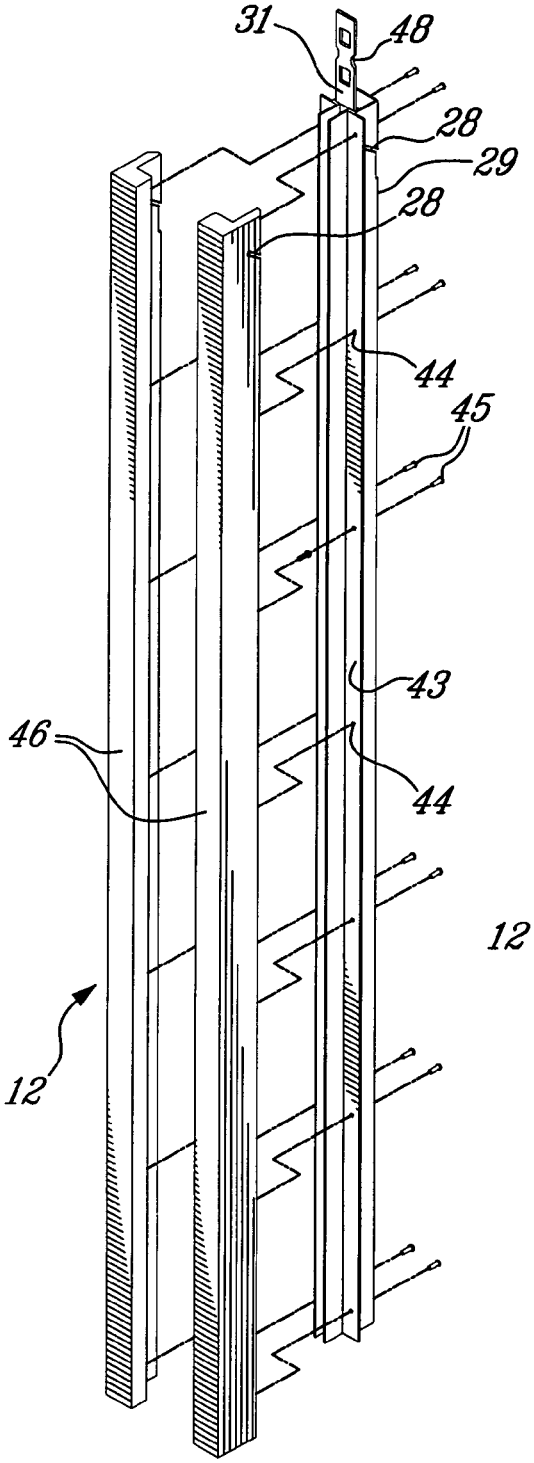
FIG. 6A is an exploded view showing the assembly of the extruded metal rail and its connection to rail concealing components.
Figure 6B:
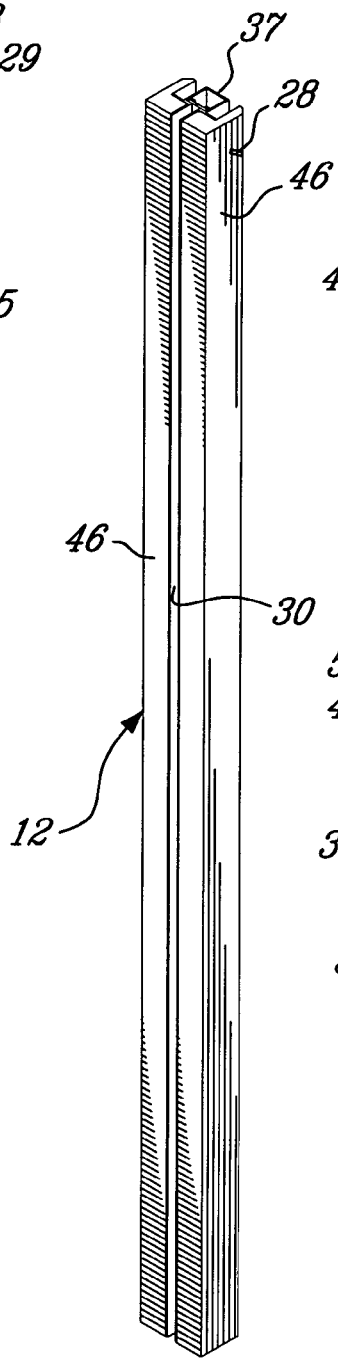
FIG. 6B is an assembled view of FIG. 6A.

The extruded metal rail member 12' further defines connector flange 43 formed integral therewith and extending in a forward end of the opposed side walls 39 of the rear channel 37 and project laterally outward and lateral of an associated one of the vertical flanges 42. Each connector flange 43 and its associated vertical flange 42 form an elongated right angle corner. The connector flanges 43, as illustrated in FIG. 6A, are provided with a plurality of holes 44 therein whereby to receive fasteners 45 from a rear face of the connector flange for securing rail concealing components 46 thereto such as the right angle wood components as illustrated in FIGS. 6A and 6B. These components could also be glued or secured differently to the connector flanges 43. These are elongated decorative outer edge components selected from material to complement the furnishings of the system to be attached to the wall hanging system of the present invention.

As shown in FIG. 7 the connector bar 31 is provided with securement means in the form of notches 48 disposed at predetermined locations along the opposed longitudinal side edges 49 of the bar and the connector bar 31 is precisely positioned within the connector receiving channels 40 in the extruded rail member 12' and disposed in a jig (not shown) whereby indentations 50 are formed at precise locations in the side walls 39 to connect with these securing notches 48, as shown in FIG. 7. Accordingly, the connector bar is secured immovable within the extruded rail member 12'.

Figure 9A:
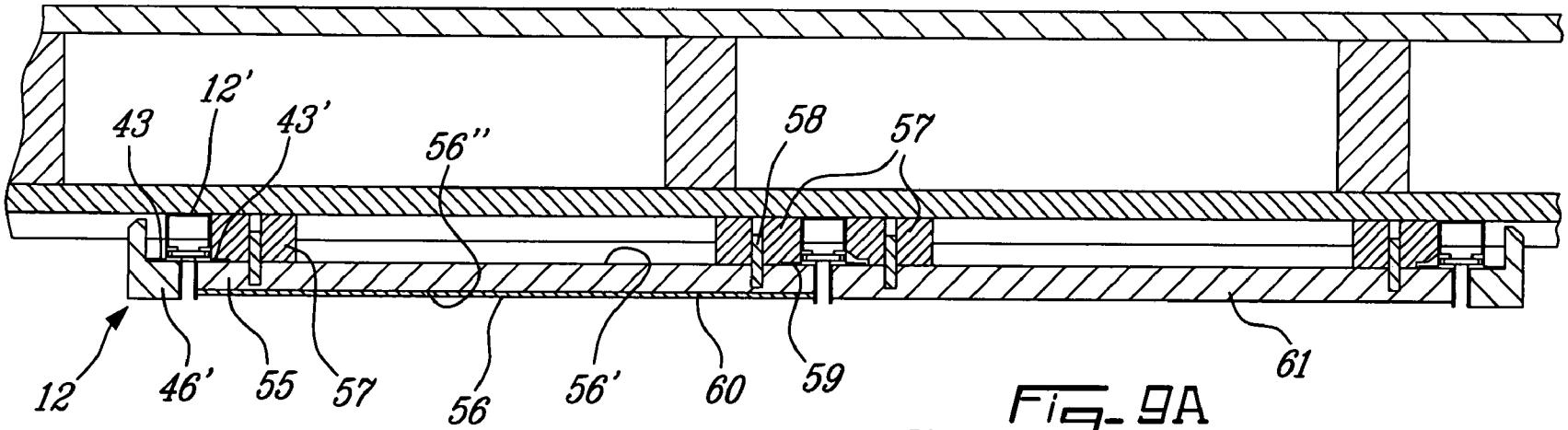
FIG. 9A is a top section view, partly fragmented, of an assembly secured to a wall and wherein the assembly is comprised of panels.
Figure 9B:
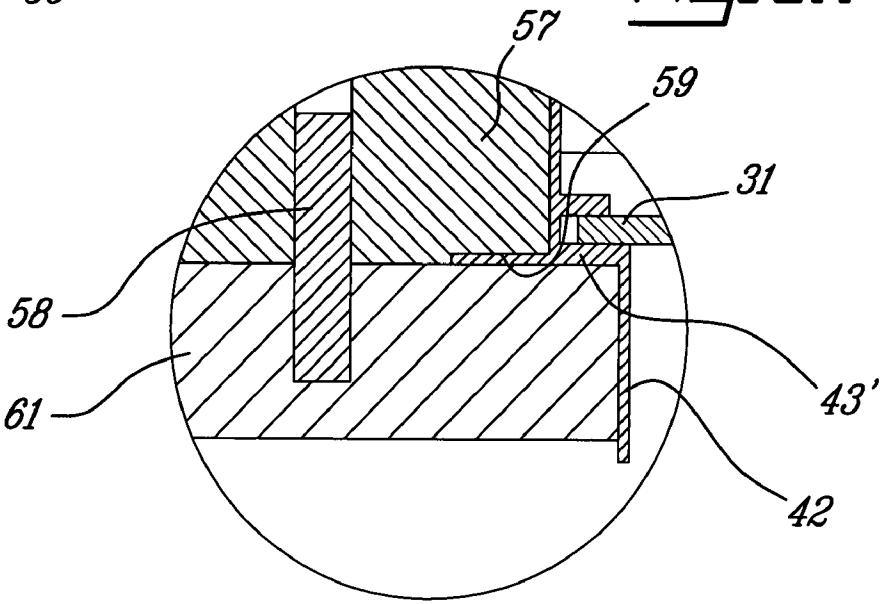
FIG. 9B is an enlarged view illustrating the connection of panels to the suspension rails.

With reference now to FIG. 9 there is shown a system wherein the support rail 12 is provided with a single outer rail concealing component 46' secured to the outer right angle corner of connector flange 43 of the extruded metal rail member 12'. The other connector flange 43' (the inner flange) receives a vertical end edge section 55 of a panel 56. The panel 56 is provided with connector blocks 57 secured by fasteners 58 (wooden dowels) and spaced slighty inwardly on a rear surface 56' of the panel 56 and defines a connector slot 59 for receiving in snug fit therein a connector flange 43, herein flange 43' of the suspension rail 12 therein. The fasteners 58 extend into the panel rear surface 56'. There are connector blocks 57 in each top corner of the panel 56 and along the opposed side edges at mid-length. The top corner connector blocks have slots therein the same as slots 28 of the rails 12, to suspend the panel 56 on the holding flange 21 of the support strip 20. The support rails 12 are secured to the wall surface by fasteners to lock the panels 59 in place.

Figure 10:
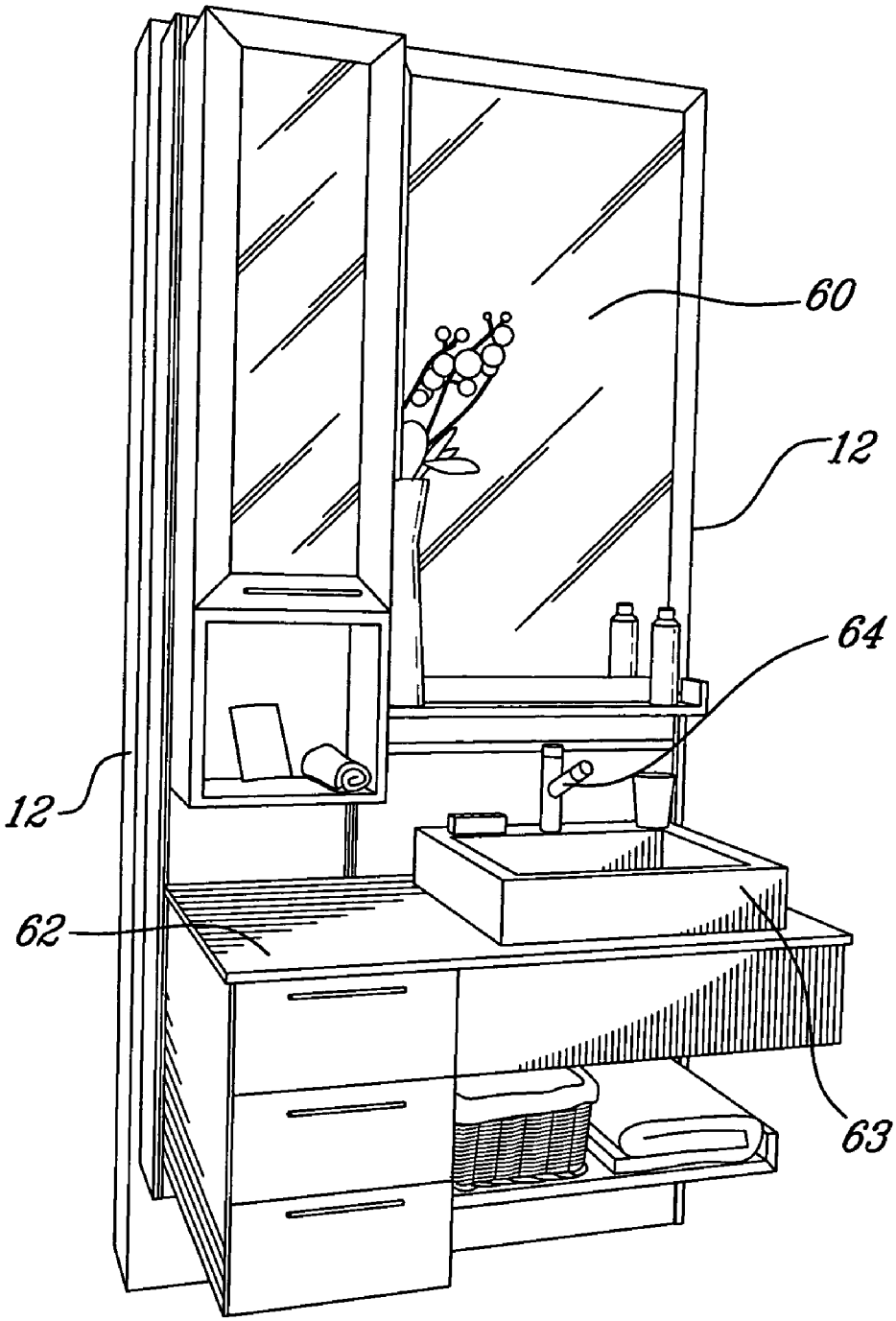
FIG. 10 is a perspective view showing the wall hanging system utilized with articles of furnishing to show the flexibility of the system of the present invention.

As shown in FIG. 9, these panels 56 may also have mirrors, such as shown in 60, secured to an outer flat surface 56" thereof or they may be plain panels, as shown at 61, and have a wood textured outer surface to complement the furnishings of the assembly. The furnishings of the assembly may have a multitude of designs and secured to the wall hanging system of the present invention. As shown in FIG. 10, an example of such an assembly may incorporate a bathroom counter 62 having a sink 63 mounted thereon with associated plumbing 64. FIG. 10 illustrates flexibility of this system and the quality of its furnishings.

Figure 11:
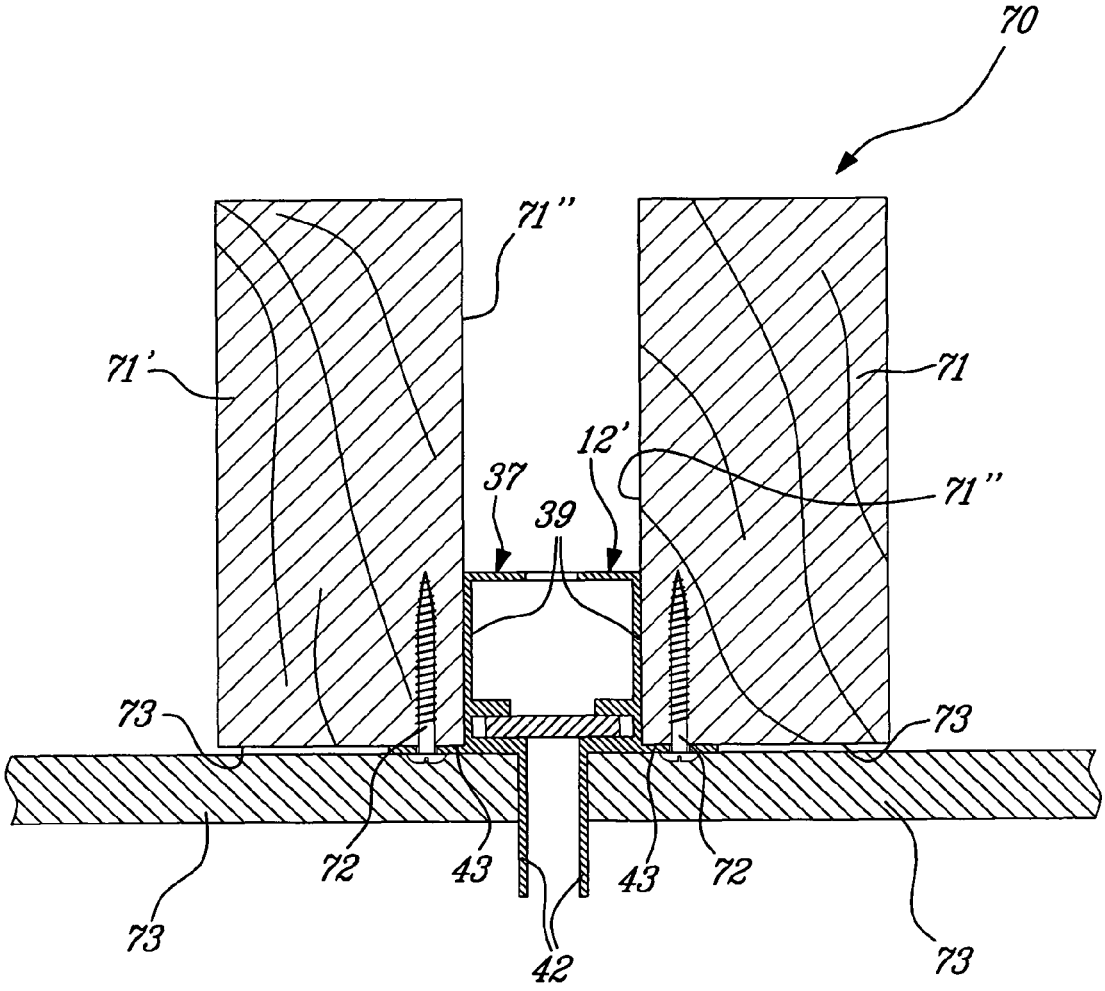
FIG. 11 is a section view of an alternate use of the extruded metal rail of the wall hanging system of the present invention incorporated in a permanent wall structure.

With reference now to FIG. 11 there is shown another use of the extruded metal rail member 12' . As herein shown the extruded metal rail member 12' is secured in a permanent wall structure 70. The permanent wall structure 70 is constructed with pairs of vertical studs 71 and 71' each mounted with the extruded metal rail member 12' disposed therebetween with each connector flange 43 secured to the front face 73 of the studs 71 and 71' in a corner portion of the stud with the side walls 39 of the rectangular rear channel 37 abutting against the inner side wall 71" of the studs. The extruded rail member 12' is secured by fasteners 72 disposed within the holes 44 provided in the connector flanges 43. After the rail members 12' have been mounted at desired locations, a facing material such as gyps boards 73 is secured over the studs and in abutting relationship with the forwardly projecting vertical flanges 42 of the extruded rail member 12'. The vertical flanges 42 may be formed shorter for this application and the connector flange 43 could also be formed wider, as is required.

It is within the ambit of the present invention to cover any obvious modifications of the preferred embodiment described herein, provided such modifications fail within the scope of the appended claims.

The invention claimed is:

1. A wall hanging system comprising a rigid straight load support flat strip having means to secure itself in a horizontal position on a wall surface, said load support flat strip having a straight flat bottom edge and a straight top edge, a holding flange formed with said top edge and projecting obliquely upward and outward thereof, two or more straight suspension rails each having an attaching slot extending from a straight flat rear wall thereof and into opposed side walls and configured to receive said holding flange thereacross spaced below a top end of said suspension rail for suspending and slidingly displacing said suspension rail therefrom to a desired location therealong with said straight flat rear wall of said suspension rail lying in flat contact on said flat strip below said holding flange and said wall surface above and below said load support strip, said suspension rail having a straight central vertical slot formed in a front wall thereof, an elongated connector bar spaced inwardly and across an open front end of said straight central vertical slot for removable securement of article support connectors thereto, said straight suspension rail being an extruded single piece metal rail member comprising an elongated U-shaped rear channel having said straight flat rear wall and said opposed side walls integrally formed, a connector bar receiving channel facing forwardly of an open front end of said rear channel along a front end of said opposed side wall for receiving said elongated connector bar disposed in sliding fit in said connector bar receiving channel to bridge said open end, said connector bar being disposed parallel and spaced forward of said flat rear wall, and a pair of spaced vertical flanges projecting forwardly of said front wall and defining said straight central slot therebetween, said extruded single piece metal rail further having a pair of connector flanges formed integral with said front wall, each connector flange of said pair of connector flanges projecting laterally outwards of a front end of said opposed side walls and lateral of an associated one of said pair of spaced vertical flanges, a rail concealing right angle component secured to at least one of said connector flange and having a front section extending entirely over a front surface of said connector flange and a transverse side section projecting rearwardly of an outer edge of said connector flange spaced from said opposed side walls of said U-shaped rear channel to conceal said opposed side walls of said elongated U-shaped rear channel, said transverse section of said rail concealing right angle component also having an attaching slot configured and disposed for transverse alignment with said attaching slots of said suspension rail to which said right angle component is secured.

2. A wall hanging system as claimed in claim 1 wherein said connector bar is a flat metal bar having a plurality of spaced apart vertically disposed straight connecting slots, and securement means to secure said connector bar at a predetermined position along and between said connector bar receiving channels.

3. A wall hanging system as claimed in claim 2 wherein said securement means is constituted by notches formed in apposed longitudinal side edges of said connector bar, and indentations formed in each said opposed side walls in said bar receiving channels and in alignment with said notches with said connector bar disposed at a precise position in said connector bar receiving channels.

4. A wall hanging system as claimed in claim 1 wherein said connector flanges are provided with holes therein to receive fasteners from a rear face thereof in an access space formed by said spacing between said transverse side section of said rail concealing right angle component and an associated one of said opposed side walls to secure said rail concealing components thereto and conceal said fasteners.

5. A wall hanging system as claimed in claim 4 wherein said rail concealing components are constituted by an elongated decorative outer edge component textured to match an article of wall furnishing.

6. A wall hanging system as claimed in claim 1 wherein said means to secure said load support strip is constituted by a plurality of holes to receive fasteners to secure said load support strip to vertical studs concealed behind an exterior wall sheeting material.

7. A wall hanging system as claimed in claim 6 wherein said load support strip is an elongated steel strip.

8. A wall hanging system as claimed in claim 1 wherein said article support connectors are flat flange connectors each defining at least two spaced apart connecting fingers formed integral with a rear edge thereof for support engagement with at least two of said vertically disposed straight connecting slots in said connector bar, said flange connectors being secured to an article of wall furnishing.

9. A wall hanging system as claimed in claim 1 wherein said flat rear wall is provided with holes to receive fasteners to immobilize said suspension rail on a wall surface.

* * * * *